US006863618B2

(12) United States Patent
Perry

(10) Patent No.: US 6,863,618 B2
(45) Date of Patent: Mar. 8, 2005

(54) FLAT SHAFT GOLF CLUBS AND PUTTERS

(75) Inventor: Reginald S. Perry, 1569 Main St. #26, West Warwick, RI (US) 02893

(73) Assignee: Reginald S. Perry, West Warwick, RI (US)

( * ) Notice: Subject to any disclaimer, the term of this patent is extended or adjusted under 35 U.S.C. 154(b) by 0 days.

(21) Appl. No.: 10/369,862

(22) Filed: Feb. 21, 2003

(65) Prior Publication Data

US 2004/0166958 A1 Aug. 26, 2004

(51) Int. Cl.[7] ..... A63B 53/10; A63B 53/12
(52) U.S. Cl. ..... 473/242; 473/316
(58) Field of Search ..... 473/315–323, 473/293, 231, 238, 226, 240, 251, 254; D21/756, 757, 758

(56) References Cited

U.S. PATENT DOCUMENTS 4,240,631 A 12/1980 MacDougall
4,240,636 A 12/1980 Swenson
4,558,863 A 12/1985 Haas et al.
4,563,007 A 1/1986 Bayliss
4,629,191 A * 12/1986 Mancuso ..... 473/203
5,026,062 A * 6/1991 Freeberg ..... 473/238
5,545,094 A * 8/1996 Hsu ..... 473/317
5,653,644 A * 8/1997 Jaeckel ..... 473/303
5,820,480 A 10/1998 Cheng
5,890,977 A * 4/1999 Taylor ..... 473/409
5,916,040 A * 6/1999 Umazume ..... 473/317
5,921,868 A * 7/1999 DiMartino ..... 473/254
6,039,656 A * 3/2000 Fireman ..... 473/131
6,540,622 B2 * 4/2003 Buchanan ..... 473/300
6,626,768 B2 * 9/2003 Roelke ..... 473/296

* cited by examiner

*Primary Examiner*—Stephen Blau

(57) ABSTRACT

A flat shaft for use with conventional golf clubs and putters which includes a flat side of the shaft that faces the target at address. The flat shaft enables the user to view the golf ball with clear, non-distorted contrast on a flat plain, because your eye lines up the ball vertically. When the flat shaft is pointed at the target at address it also squares the golf club head. Tennis rackets and hockey sticks have flat shafts because they provide the best view of objects striking the hitting surface. The flat shaft device is positioned slightly ahead of putter head for recessed contact.

7 Claims, 4 Drawing Sheets

FLAT SHAFT GOLF CLUBS AND PUTTERS

BACKGROUND OF THE INVENTION

The present invention relates to the field of golf clubs and putters. More particularly, it relates to a golf shaft that gives high accuracy, clear sight of the golf ball at address and squares up the golf club head when flat shaft is facing target. Although many types of golf club shafts exist, none are as reliable offering a nondistorted clear view of the golf ball and hitting surface as the one Applicant herein has invented.

Two common problems in golf are sight and feel which translates into missed targets and high scores. Problems of sight and feel are particularly severe when golf club design still gives a sense of hitting a round object with a tube rounded shaft. The idea is to then hit the ball square on a flat plain. Many golf devices previously contemplated which purport to resolve this problem by flattening the grip to give flat feel but visually you still see a round ball and round tubular golf shaft. Bayliss U.S. Pat. No. 4,563,007 discloses a shaft using thickness, with the outer diameter and thickness larger and stepping down to a smaller diameter end or head portion. This device tapers down to give torsional stiffness and better ball sight, but still makes a user susceptible to viewing a round golf ball next to a circular shaft on a horizontal plain. Cheng U.S. Pat. No. 5,820,480 does not provide such a device. None provide a device that from tip to the handle of the shaft having a flat edge that lets the user know that the club is square and gives a vertical view of the ball.

SUMMARY OF THE INVENTION

The device contemplated by this Applicant which overcomes the inherent deficiencies found in the prior art would enable user sight of the ball on a vertical plain, locate the squaring of the golf club head at address and contact. Knowing that the club is in proper position at contact is made evident by the flat face of the shaft in direction of target. Applicant has created such a device. The device is the shaft part of a golf club attached by grip on the top end and a golf club head on the lower end. Flat side of shaft is facing target at address. The club shaft turns from flat to round during golf swing to give user contrast and awareness of where correct golf head position is throughout golf swing. The device contemplated made of graphite or metal, textured on flat side of the shaft. Shaft flat face can be concave, converse, or just flat. The rear portion of the shaft facing away from the target can be round or tubular. Putters can be designed with flat shafts blended into recessed putter head to give the greatest sense of control and accuracy. Applicants device also maintains golf grips flat on same side as shaft facing target. Still another object of the present invention is to colorize shaft flat face, being in contrast to back half of shaft or edge lines on shaft to line up plains to strike ball. Yet another object is to provide quality highly accurate golf clubs at an inexpensive price.

In an alternative embodiment, the device may include an improved golf club comprising: a grip; a shaft having a top section and a bottom section, wherein the top section extends from the grip in a substantially linear fashion, the shaft including a front portion and a rear portion, the front portion of the shaft having a substantially perpendicular relation to a substantially straight line extending from the shaft to a target, the front portion including a substantially flat front shaft surface, the rear portion including a substantially non-flat rear shaft surface; and a head joined to the bottom section of said shaft. The improved golf club may include a front portion of the shaft that includes a textured surface. Alternatively, the front portion of the shaft may include a substantially smooth surface.

In another embodiment the improved gold club shaft may include coloring on the front and rear portions of the shaft, the coloring on the front portion contrasting with the color on the rear portion. Additionally, the shaft may be substantially rounded, and include alignment markings.

Further, the shaft may be sufficiently shaped to cooperate with the golf club head, the golf club head being located in a recessed position in relation to the shaft.

BRIEF DESCRIPTION OF THE DRAWINGS

The novel features considered characteristic of the invention are set forth in the appended claims. The invention itself however, both as to its construction and its method of operation, together with additional objects and advantages thereof, will best be understood from the following description of the specific embodiments when read and understood in connection with the accompanying drawings.

DETAILED DESCRIPTION OF THE PREFERRED EMBODIMENT

Figure 1:
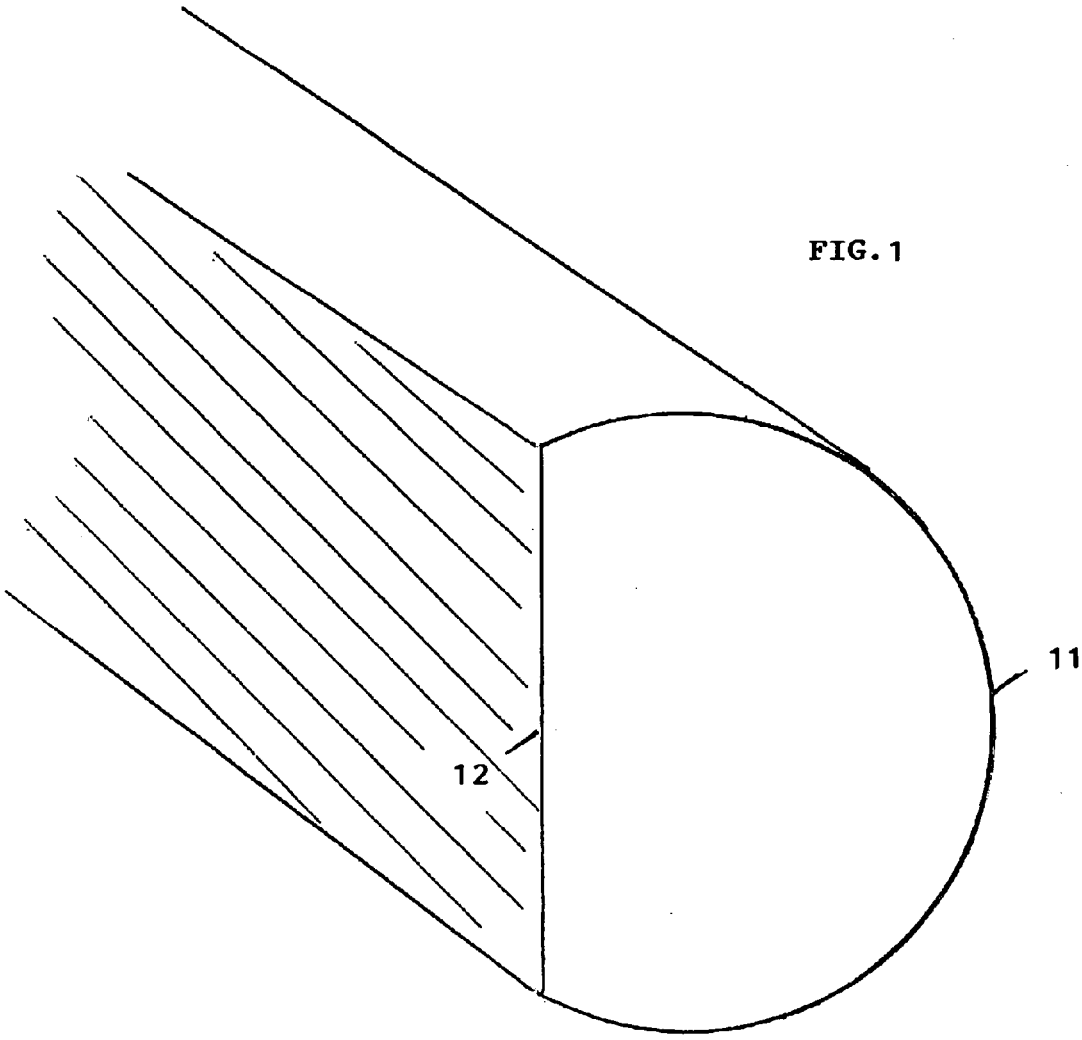
FIG. 1 is a flat shaft depicting the flat front of the shaft and a rounded rear of shaft.
Figure 2:
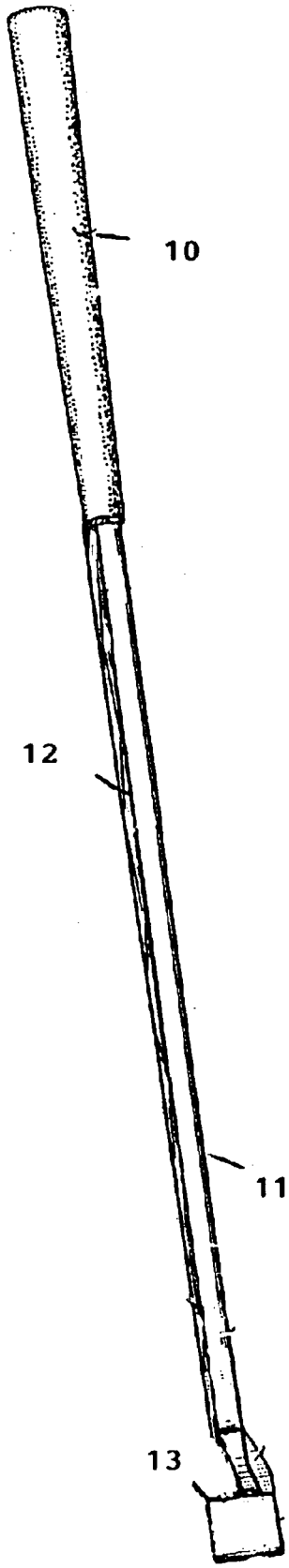
FIG. 2 is a front elevation of FIG. 3 flat shaft left side and rounded oval rear of shaft on putter.
Figure 3:
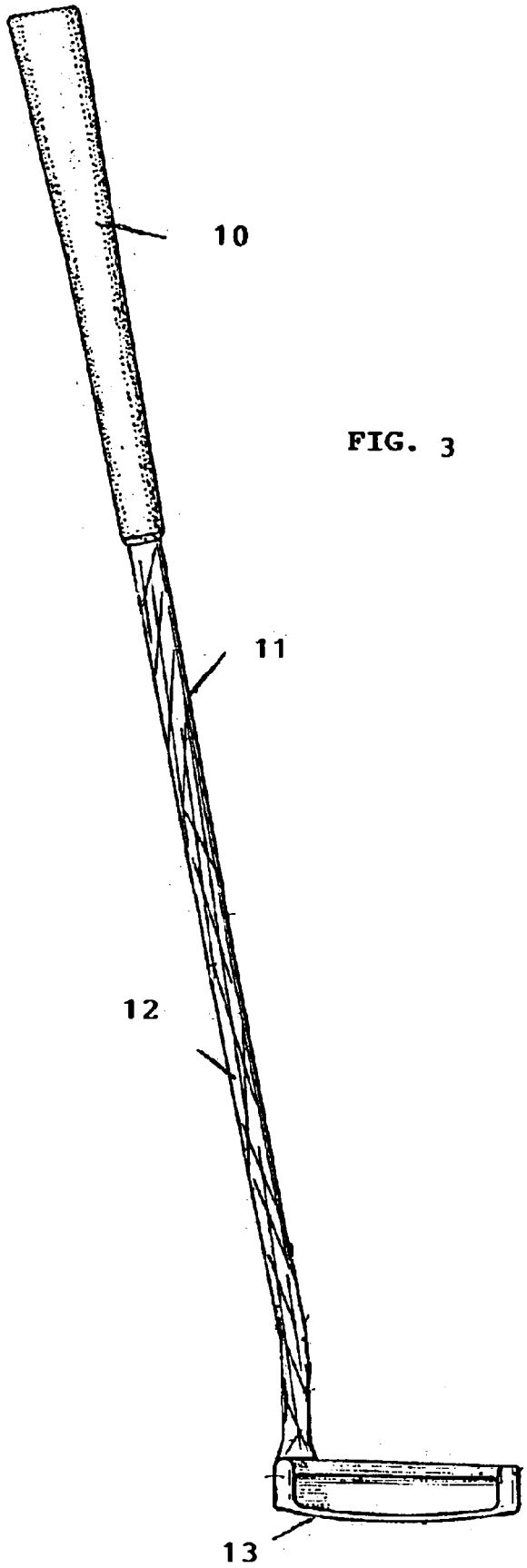
FIG. 3 is a side elevation of a flat shaft in accordance with the present invention shown on a putter. Shaded area is flat portion of shaft.

Reference to the presentation is best had by review of FIGS. 1 through 3. The flat shaft 12 comprises a shaft 11 attached to a golf grip handle 10 and a golf club head 13. Flat 12 is made of metal or graphite materials with joint assembly to hold golf grip and golf head to shaft. FIG. 2 depicts 12 front of flat shaft which faces the target at address and 11 the rounded rear of the flat shaft which faces the opposite of the target at address. 12 flat from handle to golf head.

FIG. 1 is a cross section of the flat shaft, 12 depicting the flat front which extends the full length of the shaft. 11 depicts the rear of shaft which can be any shape as long as it enhances flat front.

Figure 4:
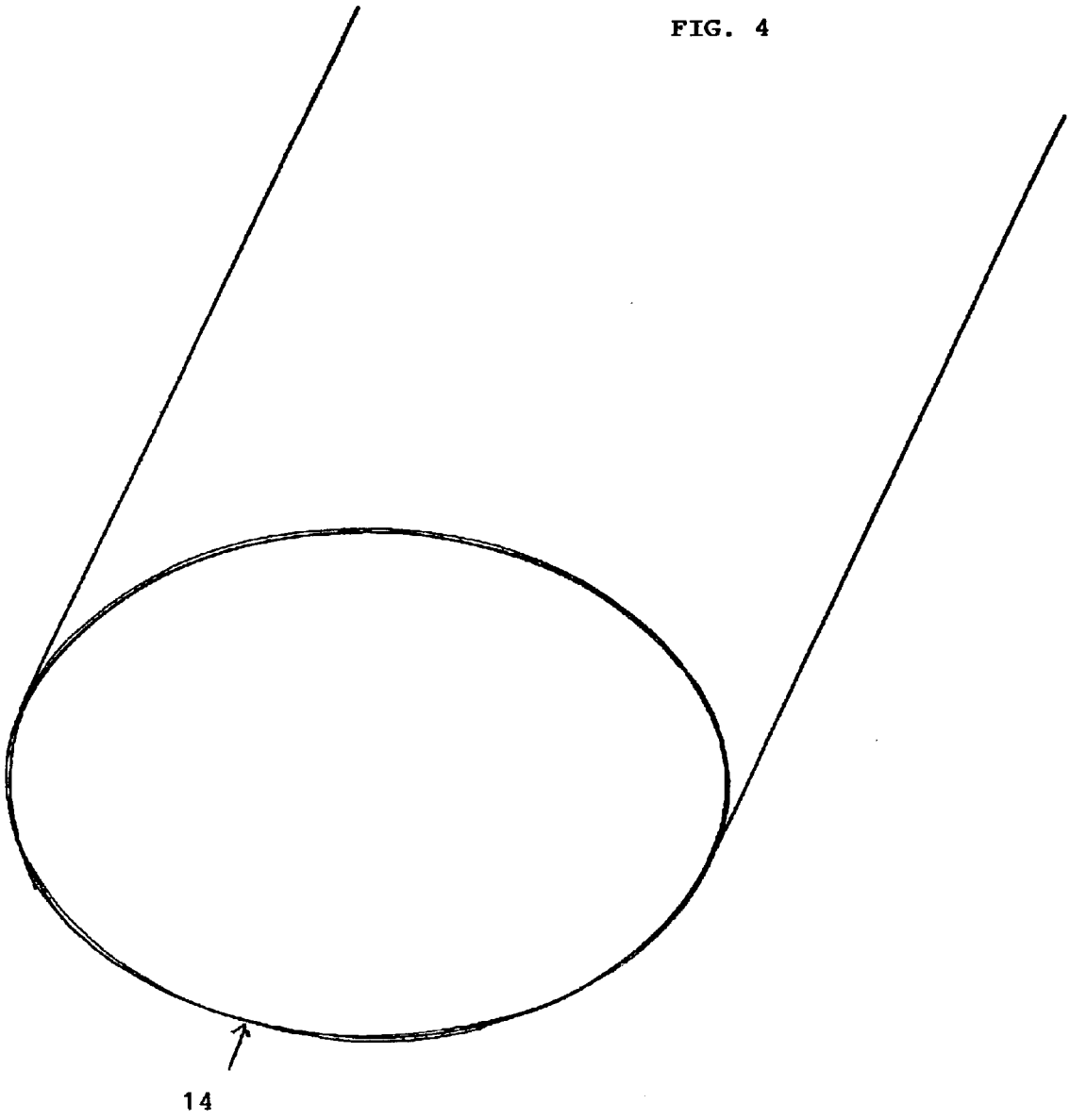
FIG. 4 is a cross section of a round or oval standard golf shaft.

FIG. 4 depicts the standard golf shaft rounded or oval cylinder shaped. Thus the present invention provides a golf shaft that gives you the best view of the golf ball at address and at take away. It also provides a golf shaft that gives you the security of knowing that the golf head is square at impact, because the flat front of the shaft is pointed at target, reducing fade and slice. As such, while the invention has been described and illustrated with reference to specific embodiment, it is understood that other embodiments may be resorted to without departing from the invention. Therefore the form of the invention set out above should be considered illustrative and not as limiting the scope of the following claims.

What is claimed is:

1. An improved golf club including an alignment assisting surface, said golf club comprising:

a grip, said grip having a substantially rounded front portion;

a non-tapered, linear shaft having a top section and a bottom section, wherein said top section extends from said grip in a substantially linear fashion said shaft having a uniform cross-section extending from said top section to said bottom section including a front portion and a rear portion, said front portion is formed as a substantially flat front alignment assisting surface, wherein said flat front surface of said shaft is substantially perpendicular to a substantially straight line extending from said shaft to a target, said rear portion including a substantially non flat rear shaft surface; and a head joined to said bottom section of said shaft.

2. The improved golf club of claim 1, wherein said alignment assisting surface of said shaft includes a textured surface.

3. The improved golf club of claim 1, wherein said alignment assisting surface of said shaft includes a substantially smooth surface.

4. The improved golf club of claim 1, wherein said shaft includes coloring on said alignment assisting surface and said rear portions of said shaft, said coloring an said alignment assisting surface contrasting with said color on said rear portion.

5. The improved golf club of claim 1, wherein said rear portion of said shaft is substantially rounded.

6. The improved golf club of claim 1, wherein said shaft includes alignment markings.

7. The improved golf club of claim 1, wherein said shaft is sufficiently shaped to cooperate with said golf club head, said golf club head being in a recessed position in relation to said shaft.

* * * * *